US010934892B2

(12) United States Patent
Lemaire et al.

(10) Patent No.: US 10,934,892 B2
(45) Date of Patent: Mar. 2, 2021

(54) AXIAL FLOW TURBINE HAVING A DIAPHRAGM SPLIT IN TWO HALVES AT A HORIZONTAL JOINT PLANE

(71) Applicant: General Electric Technology GmbH, Baden (CH)

(72) Inventors: Julien Lemaire, La Garenne-Colombes (FR); Eric Ollivau, Roissy en France (FR); Dominique Travers, Les Pavillon-sous-Bois (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 54 days.

(21) Appl. No.: 16/320,110

(22) PCT Filed: Aug. 3, 2017

(86) PCT No.: PCT/EP2017/069732
§ 371 (c)(1),
(2) Date: Jan. 24, 2019

(87) PCT Pub. No.: WO2018/033408
PCT Pub. Date: Feb. 22, 2018

(65) Prior Publication Data

US 2019/0226348 A1 Jul. 25, 2019

(30) Foreign Application Priority Data

Aug. 16, 2016 (EP) ..... 16290152

(51) Int. Cl.
*F01D 25/24* (2006.01)
*F01D 9/04* (2006.01)
*F01D 25/26* (2006.01)

(52) U.S. Cl.
CPC ..... *F01D 25/246* (2013.01); *F01D 9/04* (2013.01); *F01D 9/041* (2013.01); *F01D 25/243* (2013.01);
(Continued)

(58) Field of Classification Search
CPC ..... F01D 25/246; F01D 25/243
See application file for complete search history.

(56) References Cited

U.S. PATENT DOCUMENTS 3,628,884 A * 12/1971 Mierley, Sr. ..... F01D 25/26 415/213.1
3,861,827 A * 1/1975 Peabody ..... F01D 25/246 415/209.2

(Continued)

FOREIGN PATENT DOCUMENTS

DE 102012008723 A1 * 11/2012 ..... F01D 9/042
WO 2011018413 A1 2/2011
WO WO-2011018413 A1 * 2/2011 ..... F01D 5/225

OTHER PUBLICATIONS

International Search Report and Written Opinion issued in connection with corresponding PCT application No. PCT/EP2017/069732 dated Nov. 16, 2017.

*Primary Examiner* — Ninh H. Nguyen
*Assistant Examiner* — Brian Christopher Delrue
(74) *Attorney, Agent, or Firm* — Grogan, Tuccillo & Vanderleeden, LLP

(57) ABSTRACT

An axial flow turbine comprising a casing, a rotor having an axial rotational axis and rotatably mounted into the casing, at least one set of a plurality of moving blades supported by the rotor; and at least one diaphragm having an outer ring, an inner ring, concentric to the outer ring, and a plurality of static blades mounted therebetween, at least the outer ring being split in an upper half and a lower half along a vertical joint plane. The turbine diaphragm comprises an assembly
(Continued)

system for assembling the upper half to the lower half while allowing the upper half and the lower half to move axially relative to each other.

9 Claims, 3 Drawing Sheets

(52) U.S. Cl.
CPC ..... *F01D 25/26* (2013.01); *F05D 2220/31* (2013.01); *F05D 2230/60* (2013.01); *F05D 2230/64* (2013.01); *F05D 2240/12* (2013.01); *F05D 2250/41* (2013.01)

(56) References Cited

U.S. PATENT DOCUMENTS 3,966,023 A * 6/1976 Huang ..... F01D 25/243 188/381
4,274,805 A * 6/1981 Holmes ..... F01D 25/246 415/138
4,392,778 A * 7/1983 Hess ..... F01D 25/246 415/139
RE32,685 E * 5/1988 Hess ..... F01D 25/246 415/139
5,228,181 A * 7/1993 Ingle ..... B25B 27/16 228/44.5
5,487,642 A * 1/1996 Norton ..... F01D 9/023 415/209.2
5,709,388 A * 1/1998 Skinner ..... F01D 11/025 277/412
5,807,074 A * 9/1998 Fournier ..... F01D 9/041 415/209.3
6,224,332 B1 * 5/2001 Leach ..... F01D 25/243 415/126
7,419,355 B2 * 9/2008 Burdgick ..... F01D 25/243 415/209.2
8,142,150 B2 * 3/2012 Frick ..... F01D 25/24 415/214.1
8,998,578 B2 * 4/2015 Rauch ..... F01D 25/243 415/214.1
9,127,559 B2 * 9/2015 Lord ..... F01D 9/042
9,441,498 B2 * 9/2016 Edwards ..... F01D 25/243
10,378,383 B2 * 8/2019 Jasper ..... F01D 9/02
2007/0110575 A1 * 5/2007 Burdgick ..... F01D 9/042 415/209.2
2011/0250063 A1 * 10/2011 Burdgick ..... F01D 25/246 415/209.2
2011/0268579 A1 * 11/2011 Light ..... F04D 29/644 416/244 A
2013/0022453 A1 * 1/2013 Schaus ..... F01D 25/246 415/189
2013/0230392 A1 * 9/2013 Hashimoto ..... F01D 25/28 415/182.1
2013/0287563 A1 * 10/2013 Brummitt-Brown ... F01D 9/042 415/209.4
2014/0250915 A1 * 9/2014 Swan ..... F01D 9/04 60/796
2014/0338165 A1 * 11/2014 Edwards ..... F01D 25/243 29/252
2015/0078892 A1 * 3/2015 Lomas ..... F01D 25/28 415/214.1
2017/0198607 A1 * 7/2017 Shapiro ..... F01D 25/24
2017/0292390 A1 * 10/2017 Burdgick ..... F01D 25/246

* cited by examiner

AXIAL FLOW TURBINE HAVING A DIAPHRAGM SPLIT IN TWO HALVES AT A HORIZONTAL JOINT PLANE

The present invention relates to diaphragms for axial flow turbines, and in particular, steam turbines, in particular in the nuclear field.

In particular, the present invention relates to diaphragms comprising inner and outer rings, and a plurality of static blades mounted therebetween. Each inner and outer ring is generally split in two halves, along a joint plane of the turbine, for assembly around the rotor of the turbine. The present invention relates particularly to the connection between the upper and lower halves of each ring, and especially of the outer ring of the diaphragm.

A steam turbine is a rotating machine intended to convert the thermal of the steam into mechanical energy for driving an alternator, a pump or any other rotary mechanical receiver. Generally, steam turbines comprise a high-pressure module, a medium-pressure module and a low-pressure module.

The modules generally comprise symmetrical or non-symmetrical single or double flow inner casing enclosing a rotor equipped with mobile blades and supporting fixed or stationary blades forming a diaphragm suspended in said inner casing. The diaphragms are adapted to guide the flow of steam in a specific direction towards the mobile blades of the rotor, thereby accelerating the steam flow.

As reactor power is increasing, size of steam turbines are is also increasing, leading to casing of huge dimensions. The flexibility of the casing being dependant dependent of its size is also increased. Generally, the casing is made in two halves, slit along a plane joint, so that the turbine comprises an upper half and a lower half. Due to its huge size, it is common to observe an offset between the two halves of the casing after being assembled. Such offset leads to an axial clearance between the upper and lower contact surfaces between the upper and lower halves of the diaphragm and the casing. As the two halves of the diaphragm are rigidly connected together, for example by bolting means, this leads to a gap between the casing and the diaphragm and to leakage of the steam through this gap. Steam may thus flow through such gap, leading to erosion and decrease in performance of the turbine, as steam is not going through the steam path, i.e. through the blades of the diaphragm.

It is an object of the present invention to remedy the above drawbacks.

It is a particular object of the present invention to reduce steam leakage inside the turbine by ensuring a proper axial contact between the diaphragm and the casing in any case.

In one embodiment, an axial flow turbine comprises a casing, a rotor having an axial rotational axis and rotatably mounted into said casing, at least one set of a plurality of moving blades supported by said rotor, and at least one diaphragm having an outer ring, an inner ring, concentric to the outer ring, and a plurality of static blades mounted therebetween. At least said diaphragm is split in an upper half and a lower half along a horizontal joint plane.

Said turbine diaphragm comprises an assembly system for assembling the upper half to the lower half while allowing the upper half and the lower half to move axially relative to each other.

Thanks to the axial degree of freedom of the diaphragm lower and upper halves, axial contact between the diaphragm and the casing is ensured, preventing any steam leakage.

In an embodiment, the assembly system comprises a guiding element for axially guiding the upper half and the lower half, and at least one fastening element on each side for fastening the upper and lower halves together while allowing a relative axial movement of the halves relative to each other, said fastening element being perpendicular to the horizontal joint plane.

In one embodiment, the fastening element has a screw head, a smooth shrank portion and a threaded portion.

The diaphragm upper half may be formed with a drilling, made along the vertical axis, and having a diameter bigger than the diameter of the shrank smooth portion and the lower half may be formed with a threaded bolt hole coaxial with the drilling of the upper half and adapted to receive the threaded portion of the fastening element.

In one embodiment, the assembly system comprises a spacing element provided underneath the screw head of the fastening element, in order to control the clearance underneath said screw head.

In one embodiment, the guiding element of the assembly system comprises a feather key rigidly tightened to the upper half by two screws and an axial groove machined on the joint surface of the lower half and adapted to receive said feather key, an axial clearance being set between each side of the feather key and each axial edge of said axial groove allowing the feather key to slide inside said axial groove. The two halves thus have an axial degree of freedom relative to each other.

In an embodiment, the guiding element of the assembly system comprises at least one cylinder positioned in an axial drilling provided in both the upper and lower halves of the diaphragm, the outer diameter of the cylinder being smaller than the inner diameter of the axial drilling.

In an embodiment, a clearance is observed between the screw head and the diaphragm upper half.

The present invention will be better understood from studying the detailed description of a number of embodiments considered by way of entirely non-limiting examples and illustrated by the attached drawings in which.

In the further description, terms "horizontal", "vertical", "front", "back", "left", and "right" are defined according to the usual orthogonal bench mark of turbines, illustrated on the Figures, and including:

a turbine axis Z, around which rotor is turning, a horizontal axis X in the half joint plane, perpendicular to Z axis;

a vertical axis Y, perpendicular to the horizontal axis X and the rotational axis Z;

The following detailed description of the exemplary embodiments refers to the accompanying drawings. The same reference numbers in different drawings identify the same or similar elements. Additionally, the drawings are not necessarily drawn to scale.

Figure 1:
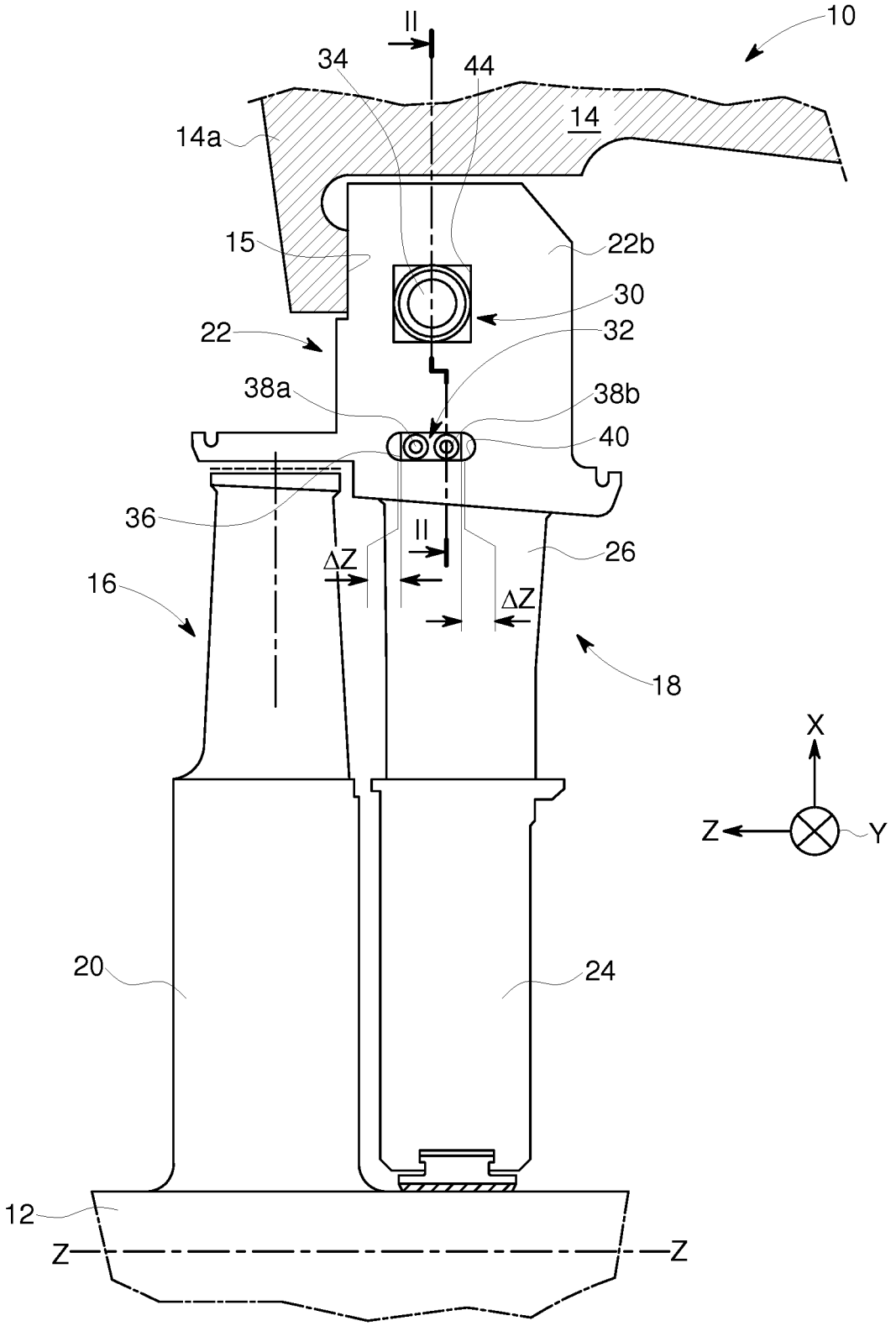
FIG. 1 is a schematic view of a part of a steam turbine according to an embodiment of the present invention.

As illustrated on FIG. 1, a part of an axial flow steam turbine 10, for example, the low-pressure, the medium-pressure or the high-pressure module of the turbine, comprises a rotor 12, having an axial rotational axis Z, rotatably mounted into a casing 14 and supporting a plurality of moving blades 16 and a plurality of diaphragms 18. Only one diaphragm is shown on FIG. 1. However, it could be possible to provide more than two diaphragms assembled together.

The moving blades 16 are supported by the rotor 12 by blade roots fixed to a rotor disc 20. The moving blades are known from the man skilled in the art and will not be further described.

As illustrated, the diaphragm 18 comprises an outer ring 22, an inner ring 24, concentric to the outer ring, and a plurality of static blades or vanes 26 mounted therebetween.

Figure 2:
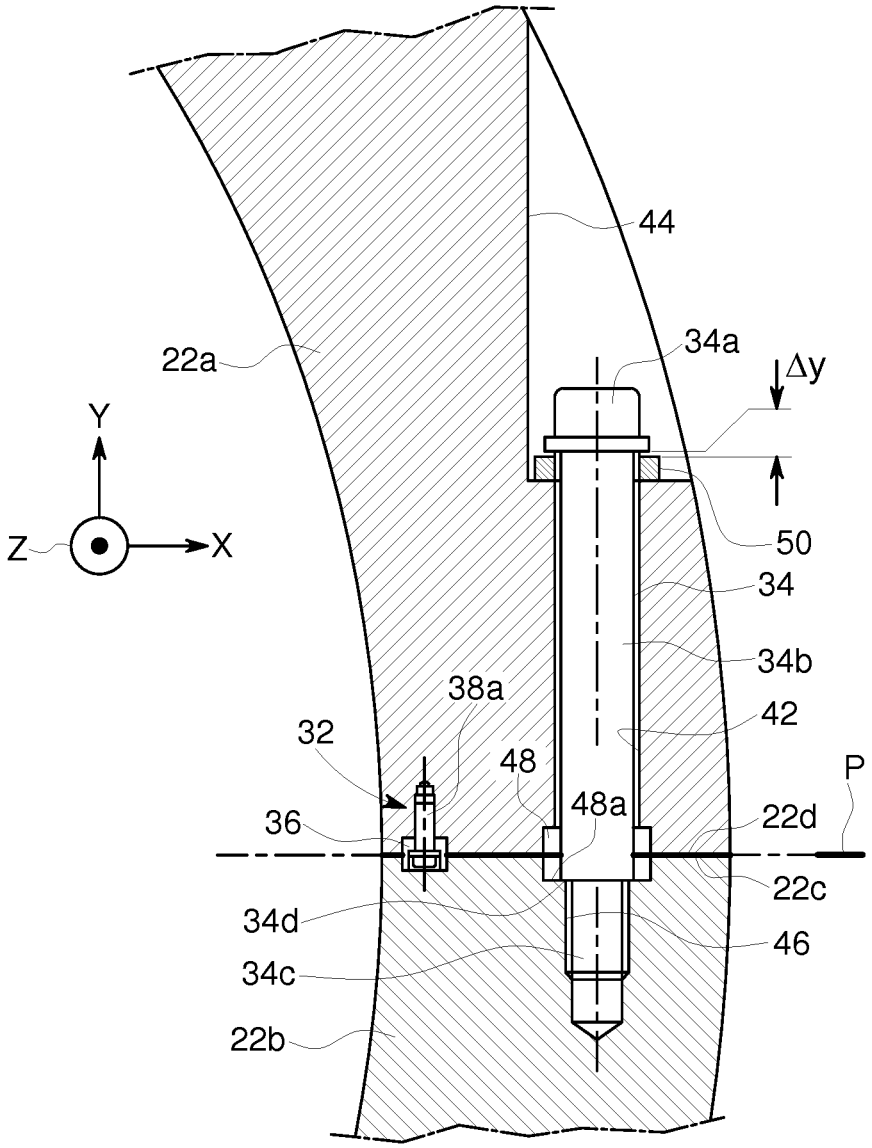
FIG. 2 is a cross section along line II-II of FIG. 1.

As can be seen on FIG. 2, the outer ring 22 of the diaphragm 18 is split in two halves, an upper half 22A and a lower half 22B, along horizontal joint plane P. Each of the two halves 22A, 22B has a pair of opposed, joint surfaces 22D22C, 22D. (Only one of each pair is shown on FIG. 2)

The casing 14 of the turbine is also split into a lower half 14A surrounding the lower half 22B of the diaphragm's outer ring 22 and an upper half (not shown) surrounding the upper half 22A of the diaphragm's outer ring 22. The lower and upper halves of the casing are split along the same horizontal joint plane P.

The upper and lower halves 22A, 22B of the outer ring 22 diaphragm are connected together by an assembly system 30 allowing the upper half 22A and the lower half 22B to slide relative to each other along the horizontal joint plane P, so that the outer ring of the diaphragm is in axial contact with a radial face 15 of the casing. The diaphragm is thus given an axial degree of freedom, ensuring an axial contact between the diaphragm and the casing, thus preventing any steam leakage.

The assembly system 30 comprises a guiding element 32 for axially guiding the upper half 22A and the lower half 22B, and a fastening element 34 adapted to fasten the upper and lower halves 22A, 22B together while allowing a relative axial movement of the halves relative to each other.

As can be seen on the embodiment of FIGS. 1 and 2, the guiding element 32 comprises a feather key 36 rigidly tightened to the upper half 22A by two screws 38A, 38B and an axial groove 40 machined on the joint surface 22D of the lower half 22B and adapted to receive said feather key 36.

An axial clearance ΔZ is observed between each side of the feather key 36 and each axial edge of the axial groove 40 in order to allow the feather key 36 to slide inside said axial groove. The two halves 22A, 22B thus have an axial degree of freedom relative to each other.

As can be seen on the embodiment of FIG. 1, the fastening element 34 is a joint screw having a screw head 34A, a smooth shrank portion 34B and a threaded portion 34C. The smooth shrank portion 34B is longer than the threaded portion 34C.

Therefore, the diaphragm upper half 22A is formed with a hole or drilling 42, made along the vertical axis Y, accessed by a counter bore or a notch area 44 machined in the diaphragm upper half 22A. The bore of the drilling 42 is smooth and has a diameter bigger than the diameter of the shrank smooth portion 34B.

The diaphragm lower half 22B is formed with a threaded bolt hole 46 coaxial with the drilling 42 of the upper half 22A and adapted to receive the threaded portion 34C of the fastening element 34. The diaphragm lower half 22B is further provided with an undercut 48 of bigger diameter than the diameter of the threaded bolt hole 46.

The joint screw 34 is tightened and torque clamped into the lower half 22B in order to assure a good mechanical strength when torque is exerted on the diaphragm, thus preventing the diaphragm from opening at the joint plane. Therefore, when tightening the joint screw 34 into the lower half, the end 34D of the smooth shank portion 34B bears on the lower half, and more precisely on the bottom 48A48A of the undercut 48.

As illustrated on FIG. 2, a spacing element 50 is provided underneath the screw head 34A of the joint screw 34 in order to control the clearance underneath said screw head 34A. A clearance ΔY is observed between the screw head 34A and the spacing element 50. The spacing element 50 illustrated is a washer. As an alternative, any other spacing element may be used, such as, for example, a Belleville spring washer.

Such a particular structure of the joint screw allows the two halves 22A, 22B of the diaphragm's outer ring 18 to be assembled together, while allowing a relative axial movement between each other.

Figure 3:
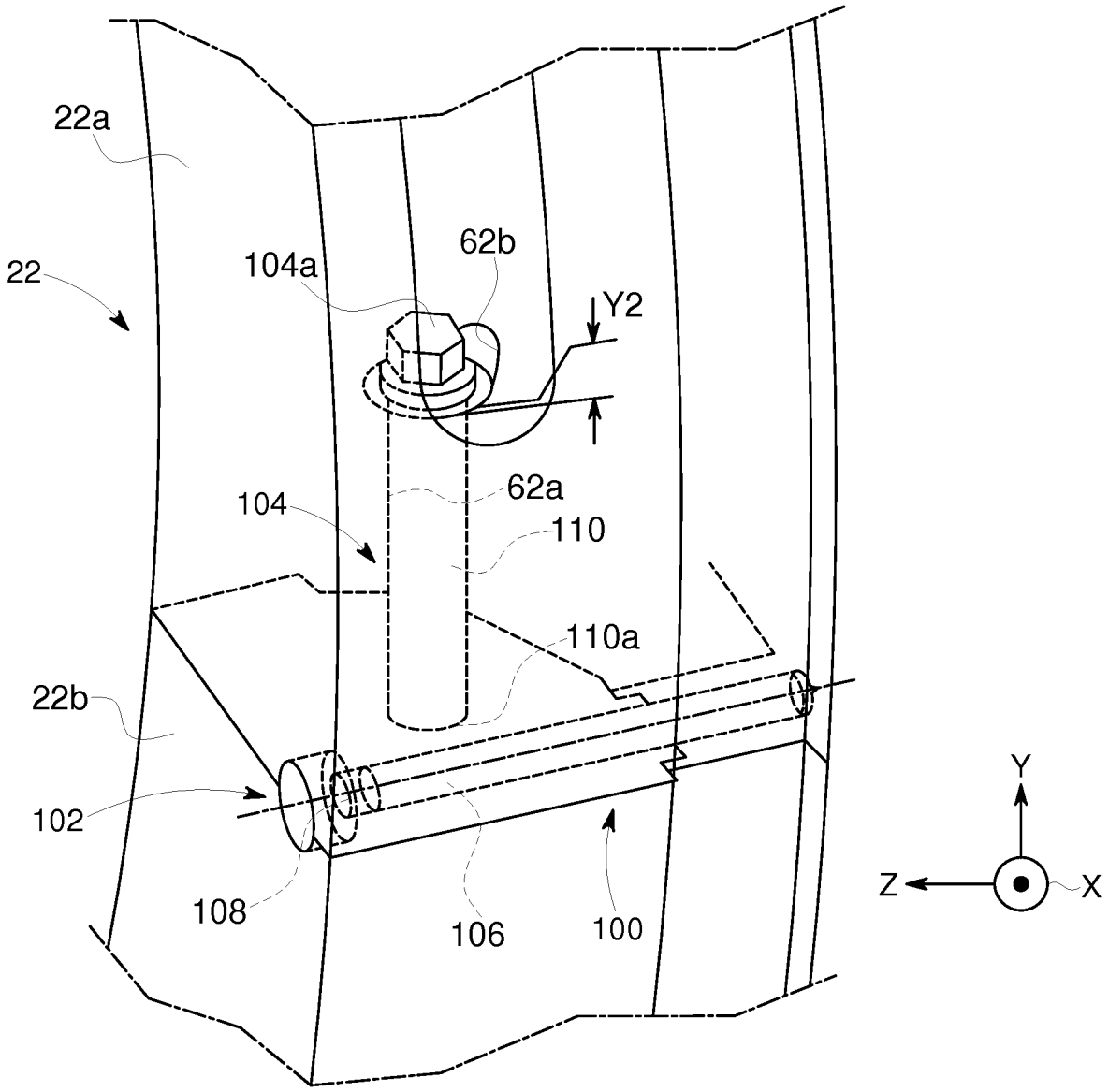
FIG. 3 is a schematic three-dimensional perspective view of a part of a steam turbine diaphragm according to another embodiment of the present invention.

The embodiment of FIG. 3, in which identical elements bear the same references, differs from the embodiment of FIGS. 1 and 2 in the structure of the assembly system of the upper and lower halves 22A, 22B of the outer ring 22 of the diaphragm 18.

As illustrated on FIG. 3, the assembly system 100 comprises a guiding element 102 for axially guiding the upper half 22A and the lower half 22B of the diaphragm 18, and a fastening element 104 adapted to fasten, respectively the upper and lower halves 22A, 22B together while allowing a relative axial movement of the halves relative to each other. As can be seen on the embodiment of FIG. 3, the guiding element 102 comprises a cylinder 106 positioned in an axial drilling 108 provided in both the upper and lower halves 22A, 22B of the diaphragm 18. The outer diameter of the cylinder 106 is smaller than the inner diameter of the axial drilling 108 so that the halves may slide axially relative to each other. A nitride washer could be added around the cylinder in order to ensure the sliding. As an alternative, a nitriding could be done directly on the cylinder itself.

As another alternative, it is possible to provide a first cylinder in both the upper and lower halves 22A, 22B of the diaphragm 22.

The fastening element 104 differs from the fastening element 34 of the embodiment of FIGS. 1 and 2 in that the fastening element 104 is tightened on a cylindrical spacer which is in contact in the counter bore hole, whereas in the embodiment of FIGS. 1 and 2, the fastening element 34 is tightened on the lower part. Said fastening element 104 comprises a screw head 104*a*, a smooth shrank portion (not shown) and a threaded portion (not shown). The smooth shrank portion is longer than the threaded portion.

The upper half 22A is formed with a hole or drilling 62A made along the vertical axis Y, accessed by a counter bore or a notch area 62*b* machined in the upper half 22A. The bore of the drilling 62A is smooth and has a diameter bigger than the diameter of the shrank smooth portion. A cylindrical spacer 110 is provided between the outer surface of the shrank portion and the inner surface of the drilling 62A. The inner diameter of the spacer 110 is bigger than the outer diameter of the shrank smooth portion of the fastening element 104. A clearance ΔY2 is observed between the screw head 104*a* and the spacer 110.

The lower half 22B is formed with a threaded bolt hole (not shown) coaxial with the corresponding drilling 62A and adapted to receive the threaded portion of the fastening element 104. The lower half 22B is further provided with an undercut (not shown) of bigger diameter than the diameter of the threaded bolt hole. In this embodiment, when tightening the joint screw 104 into the corresponding half, the end 110A of the spacer 110 bears on the bottom of the undercut.

What is claimed is:

1. An axial flow turbine comprising:

a casing, a rotor having a rotational axis (Z) and rotatably mounted into said casing, at least one set of a plurality of moving blades supported by said rotor; and at least one diaphragm having an outer ring, an inner ring, concentric to the outer ring, and a plurality of static blades mounted therebetween, at least said at least one diaphragm being split in an upper half and a lower half along a horizontal joint plane, the upper half and the lower half having opposed joint surfaces, wherein said at least one diaphragm comprises an assembly system for assembling the diaphragm upper half to the diaphragm lower half while allowing the diaphragm upper half and the diaphragm lower half to move axially relative to each other, while the opposed, joint surfaces are engaged.

2. A turbine according to claim 1, wherein the assembly system comprises a guiding element for axially guiding the diaphragm upper half and the diaphragm lower half, and at least one fastening element for fastening the diaphragm upper and diaphragm lower halves together while allowing a relative axial movement of the diaphragm upper and diaphragm lower halves relative to each other, said fastening element being perpendicular to the horizontal joint plane.

3. A turbine according to claim 2, wherein the at least one fastening element comprises a screw head, a smooth shrank portion and a threaded portion.

4. A turbine according to claim 3, wherein the diaphragm upper half comprises a drilling made along a vertical axis, and having a diameter larger than the diameter of the shrank smooth portion.

5. A turbine according to claim 4, wherein the diaphragm lower half comprises a threaded bolt hole coaxial with the drilling of the upper half and adapted to receive the threaded portion of the fastening element.

6. A turbine according to claim 3, wherein the assembly system comprises a spacing element provided underneath the screw head of the fastening element.

7. A turbine according to claim 2, wherein the guiding element of the assembly system comprises a feather key rigidly tightened to the upper half by two screws and an axial groove on a joint surface of the lower half to receive said feather key an axial clearance between each side of the feather key and each axial edge of said axial groove allowing the feather key to slide inside said axial groove.

8. A turbine according to claim 2, wherein the guiding element of the assembly system comprises at least one cylinder positioned in an axial drilling in both the diaphragm upper and diaphragm lower halves of the at least one diaphragm, the outer diameter of the at least one cylinder being smaller than the inner diameter of the axial drilling.

9. A turbine according to claim 8, wherein a clearance is between the screw head and the diaphragm upper half.

* * * * *